US007588317B2

(12) United States Patent
Imanaka et al.

(10) Patent No.: US 7,588,317 B2
(45) Date of Patent: Sep. 15, 2009

(54) PRINTING APPARATUS, PRINTHEAD, AND DRIVING METHOD THEREFOR

(75) Inventors: Yoshiyuki Imanaka, Kawasaki (JP); Takuya Hatsui, Tokyo (JP); Souta Takeuchi, Yokohama (JP); Takahiro Matsui, Koganei (JP); Kousuke Kubo, Yokohama (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 11/392,602

(22) Filed: Mar. 30, 2006

(65) Prior Publication Data

US 2006/0221105 A1 Oct. 5, 2006

(30) Foreign Application Priority Data

Apr. 1, 2005 (JP) ..... 2005-106799

(51) Int. Cl.
*B41J 2/14* (2006.01)
*B41J 2/05* (2006.01)

(52) U.S. Cl. ..... 347/48; 347/57; 347/58

(58) Field of Classification Search ..... 347/10, 347/11, 12, 13, 14, 15, 40, 43, 44, 47, 48, 347/50, 54, 55, 57, 58, 59, 61, 62, 68, 69, 347/71, 75; 358/2.1, 3.11, 3.12
See application file for complete search history.

(56) References Cited

U.S. PATENT DOCUMENTS 5,208,605 A * 5/1993 Drake ..... 347/15
5,550,568 A * 8/1996 Misumi ..... 347/12
6,074,041 A 6/2000 Imanaka et al. ..... 347/50
6,130,692 A 10/2000 Mochizuki et al. ..... 347/57
6,137,502 A * 10/2000 Anderson et al. ..... 347/15
6,243,111 B1 * 6/2001 Imanaka et al. ..... 347/13
6,293,655 B1 9/2001 Imanaka et al. ..... 347/65
6,382,755 B1 5/2002 Imanaka et al.
6,382,772 B1 5/2002 Kamiyama et al. ..... 347/57
6,439,680 B1 8/2002 Mochizuki et al. ..... 347/10
6,464,320 B1 10/2002 Maru et al. ..... 347/19
6,474,790 B2 11/2002 Kaneko
6,688,729 B1 2/2004 Imanaka et al. ..... 347/48
6,789,877 B2 * 9/2004 Murakami et al. ..... 347/40
6,896,357 B2 * 5/2005 Murakami et al. ..... 347/43

(Continued)

FOREIGN PATENT DOCUMENTS

JP 9-207334 8/1997

(Continued)

*Primary Examiner*—Stephen D Meier
*Assistant Examiner*—Rene Garcia, Jr
(74) *Attorney, Agent, or Firm*—Fitzpatrick, Cella, Harper & Scinto

(57) ABSTRACT

An object of this invention is to drive different types of printing elements arranged in a printhead by proper powers without increasing the number of signal lines between the printhead and a printing apparatus main body, complicating the circuit configuration, and decreasing the printing speed. For this purpose, time division signals representing two driving periods corresponding to two types of printing elements are supplied to a printhead having the two types of printing elements which require different application powers in order to obtain a desired printing characteristic. Power is applied to the first type printing elements in the first driving period, and power is applied to the second type printing elements in the second driving period.

8 Claims, 10 Drawing Sheets

U.S. PATENT DOCUMENTS

| | | | | |
|---|---|---|---|---|
| 6,945,633 | B2 | 9/2005 | Imanaka et al. | 347/58 |
| 7,055,923 | B2 | 6/2006 | Mochizuki et al. | 347/10 |
| 7,108,345 | B2 | 9/2006 | Mochizuki et al. | 347/12 |
| 7,258,408 | B2 * | 8/2007 | Usuda | 347/11 |
| 7,303,260 | B2 * | 12/2007 | Osada et al. | 347/47 |
| 7,367,658 | B2 * | 5/2008 | Kusunoki et al. | 347/68 |
| 2002/0071004 | A1 | 6/2002 | Kaneko | |
| 2003/0058305 | A1 * | 3/2003 | Murakami et al. | 347/47 |
| 2004/0218007 | A1 * | 11/2004 | Tomizawa et al. | 347/40 |
| 2005/0140707 | A1 | 6/2005 | Imanaka et al. | 347/9 |
| 2006/0050107 | A1 * | 3/2006 | Yamanaka et al. | 347/40 |

FOREIGN PATENT DOCUMENTS

| | | |
|---|---|---|
| JP | 2000-94692 | 4/2000 |
| JP | 2002-79672 | 3/2002 |
| JP | 2002-374163 | 12/2002 |

* cited by examiner

PRINTING APPARATUS, PRINTHEAD, AND DRIVING METHOD THEREFOR

FIELD OF THE INVENTION

This invention relates to a printing apparatus, printhead, and driving method therefor. More particularly, this invention relates to driving of a printhead having at least first type printing elements and second type printing elements which require different application powers in order to obtain a desired printing characteristic.

An inkjet printhead according to this invention can be applied to a general printing apparatus, and also to apparatuses such as a copying machine, a facsimile apparatus having a communication system, and a wordprocessor having a printing unit. Further, this invention can be applied to an industrial printing apparatus multifunctionally combined with various processing apparatuses.

BACKGROUND OF THE INVENTION

The arrangement of a printhead used in an inkjet printing apparatus which prints information (e.g., a desired character and image) on a sheet-like print medium (e.g., paper or a film) is disclosed in, for example, Japanese Patent Publication Laid-Open No. 2002-374163. According to this publication, a printing element formed from a heating element (heater), a driver for driving the printing element, and a logic circuit for selectively driving the driver in accordance with image data are formed on a silicon substrate.

Color inkjet printers using a thermal inkjet technique of discharging ink by heat energy are achieving higher resolutions year after year. Particularly in the printhead of the inkjet printer, the layout density of orifices (nozzles) for discharging ink increases from 600 orifices to 1,200 orifices per inch.

The amount of discharge ink droplet which forms each pixel tends to decrease year after year in order to reduce graininess in the gradation of a monochrome image and at middle to low-density portions on a color photographic image. Especially in a printhead which discharges color ink, the amount of discharge ink droplet was about 15 pl a few years ago, but has decreased to 5 pl or 2 pl recently.

However, the following problem occurs when a printhead which prints a high-resolution image by small ink droplets is adopted. That is, when a high-resolution color graphic image or photographic image is printed, a high-resolution, high-quality image is printed to meet the user's need if a printhead discharging a small droplet is employed. To the contrary, in image printing of a color graph on a spreadsheet or the like that does not require high resolution, the use of small ink droplets increases the scan count, and it becomes difficult to meet demands for high-speed printing.

In order to solve this problem, countermeasures must be taken to increase the number of orifices laid out on one array and increase a printable area where printing is done by one scan or to increase the orifice layout density and enable printing a high-resolution image by one scan.

For example, Japanese Patent Publication Laid-Open No. 2002-79672 discloses a printhead in which orifice arrays are staggered and laid out on the two sides of a common ink supply port (common liquid chamber). This enables the layout density of orifice arrays to become double, compared to that of a single array. Even if the ink droplet is downsized, the printing speed does not decrease.

A printhead having the highest orifice layout density has 1,200 orifices per inch, and the mainstream of the discharge ink droplet amount is 2 pl. However, in order to meet demands for higher image qualities, the discharge ink droplet amount must be reduced to 1 pl or less. Moreover, in order to maintain the same printing speed, the number (common supply number) of orifices must be increased. However, if the number of orifices of the printhead is simply increased, the printhead becomes large, which is disadvantageous in cost and size.

In order to decrease the discharge ink droplet amount to 1 pl or less and maintain the printing speed for higher image qualities, the orifice layout density must be double or more the current maximum layout density (1,200 orifices per inch). Note that when orifices are staggered and laid out on the two sides of the ink supply port, the layout density on one side suffices to be 1,200 orifices per inch.

If the orifice layout density is further increased (to 2,400 orifices (1,200 orifices on one side) per inch), it becomes difficult to ensure the necessary width of a partition which separates adjacent nozzles, and the necessary width of an ink channel which greatly influences discharge performance. To solve this problem, there is proposed an arrangement in which orifices laid out on each array are staggered by changing the distance from the common liquid chamber.

When orifices on one array are staggered, the distance from the common liquid chamber to the orifice changes. In this case, in order to attain the same orifice discharge performance between orifices having the different distances, it is considered effective to optimize, in accordance with the position, the shape and size of each electrothermal transducer (heater) for generating heat energy. However, when the shape and size of the heater are changed, driving energy applied to the heater must be adjusted in accordance with the shape.

To adjust the driving energy, it is considered to change, in accordance with the heater shape, a signal for determining the time during which electric energy is applied to the heater. In this case, however, the number of signal lines increases. In a general inkjet printhead, this leads to an increase in the number of terminals which connect the printhead to the apparatus main body since signals from the printing apparatus main body are supplied through these signal lines Also, the printing apparatus main body does not have a sufficient margin for the number of signal lines in a cable for supplying signals to the printhead. Hence, the printing apparatus main body must be modified to increase the number of signals supplied via the cable and increase the number of ASIC ports in order to output the signals.

These changes undesirably increase the size and cost of an inkjet printing apparatus of which reduction of size and cost is strongly demanded.

This problem is not limited to only a thermal inkjet printhead but common to all printheads having at least two types of printing elements which require different application electric energies (powers) in order to obtain a desired printing characteristic.

SUMMARY OF THE INVENTION

Accordingly, the present invention is conceived as a response to the above-described disadvantages of the conventional art.

For example, a printing apparatus according to the present invention is capable of driving different types of printing elements arranged in a printhead by proper powers without increasing the number of signal lines between the printhead and the apparatus main body, complicating the circuit configuration, or decreasing the printing speed.

According to one aspect of the present invention, preferably, there is provided a printhead having a substrate including at least first type printing elements and second type printing elements, comprising: a time-division driving circuit, provided on the substrate, which selects a block to time-divisionally drive the first and second type printing elements in corresponding first and second periods; and a common signal line, provided on the substrate, which supplies, to the first and second type printing elements, enable signals for designating different driving periods in the first and second periods.

In accordance with the invention as described above, a printing apparatus which prints with a printhead having at least the first type printing elements and second type printing elements, generates time-division signals representing the first and second periods corresponding to the first and second type printing elements, and supplies, to the first and second type printing elements via a common signal line, enable signals for designating different driving periods in the first and second periods.

By supplying signals representing different energization periods via a common signal line for supplying a signal for designating the energization period, appropriate powers can be applied to at least the two types of printing elements which require different application powers in order to attain a desired printing characteristic.

Hence, different types of printing elements arranged in the printhead can be driven by proper powers without increasing the number of signal lines between the printhead and the apparatus main body, complicating the circuit configuration, and decreasing the printing speed. As a result, a desired printing characteristic can be obtained by printing elements of either type.

The first and second type printing elements may have energy generating elements of different shapes. As the layout pattern, for example, the first and second type printing elements may be staggered.

The first and second type printing elements may be laid out on the same substrate at a density of 1,200 printing elements or more per inch in a predetermined direction.

Each printing element may comprise an orifice which discharges ink, and an energy generating element which is arranged in correspondence with the orifice, and may print by the inkjet method. In this case, the energy generating element may be an electrothermal transducer.

According to another aspect of the present invention, preferably, there is provided a printing apparatus which prints with a printhead having at least first type printing elements and second type printing elements, comprising: a signal generating circuit which generates time-division signals representing first and second periods corresponding to the first and second type printing elements; and a driving circuit which supplies, to the first and second type printing elements by using a common signal line, enable signals for designating different driving periods in the first and second periods.

Note that the time-division signal suffices to be a signal for dividing the first and second printing elements into a plurality of blocks for each type and driving each block by time division.

According to still another aspect of the present invention, preferably, there is provided a method of driving a printhead having at least first type printing elements and second type printing elements, comprising: a signal generating step of generating time-division signals representing first and second periods corresponding to the first and second type printing elements; and a driving step of supplying, to the first and second type printing elements via a common signal line, enable signals for designating different driving periods in the first and second periods.

The invention is particularly advantageous since signals representing different energization periods are supplied via a common signal line for supplying a signal for designating the energization period, and hence appropriate powers are applied to at least the two types of printing elements which require different application powers in order to obtain a desired printing characteristic.

Different types of printing elements arranged in the printhead can be driven by proper powers without increasing the number of signal lines between the printhead and the apparatus main body, complicating the circuit configuration, and decreasing the printing speed. In this manner, a desired printing characteristic can be achieved by printing elements of either type.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Note that building elements described in the following embodiment are merely illustrative, and do not limit the scope of the present invention.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

(Arrangement of Printhead Cartridge)

FIGS. 2 to 5 are perspective views for explaining a printhead cartridge, inkjet printhead, and ink tank which are used in an inkjet printing apparatus according to the embodiment of the present invention.

Figure 2:
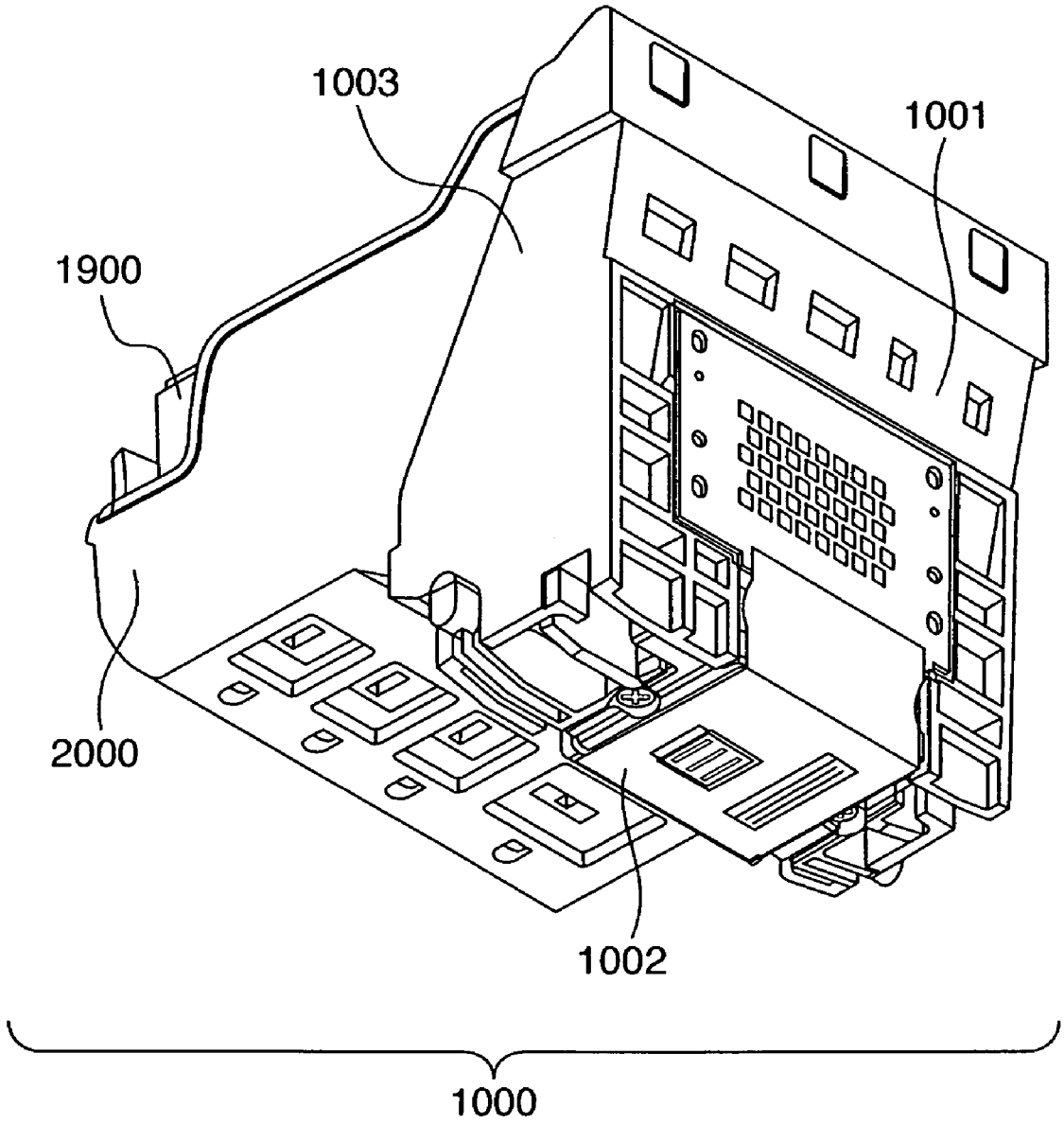
FIG. 2 is a perspective view showing a printing cartridge according to the embodiment of the present invention.

The inkjet printhead (to be simply referred to as a printhead hereinafter) is one building element of the printhead cartridge. As shown in FIG. 2, a printhead cartridge 1000 comprises a printhead 1001, and an ink tank 1900 which is detachable from the printhead 1001 and supplies ink to the printhead 1001. The printhead 1001 discharges ink, which is supplied from the ink tank 1900, from orifices in accordance with printing information, and prints a character, image, or the like on a print medium.

The printhead cartridge 1000 is detachable from the carriage of the printing apparatus. The printhead cartridge 1000 is electrically connected to the carriage via the connection terminal of the carriage. Further, the printhead cartridge 1000 is fixed and supported at a predetermined position by the positioning unit of the carriage. The ink tank 1900 has tanks for black ink, cyan ink, magenta ink, and yellow ink. Each tank of the ink tank 1900 is detachable from the printhead 1001, and each tank can be independently exchanged. This arrangement contributes to reducing the running cost of a printing operation of the printing apparatus.

The printhead 1001 adopts a method of printing using a heating element (heater) as an electrothermal transducer which generates heat energy in order to generate film boiling in ink in accordance with an electrical signal.

Figure 3:
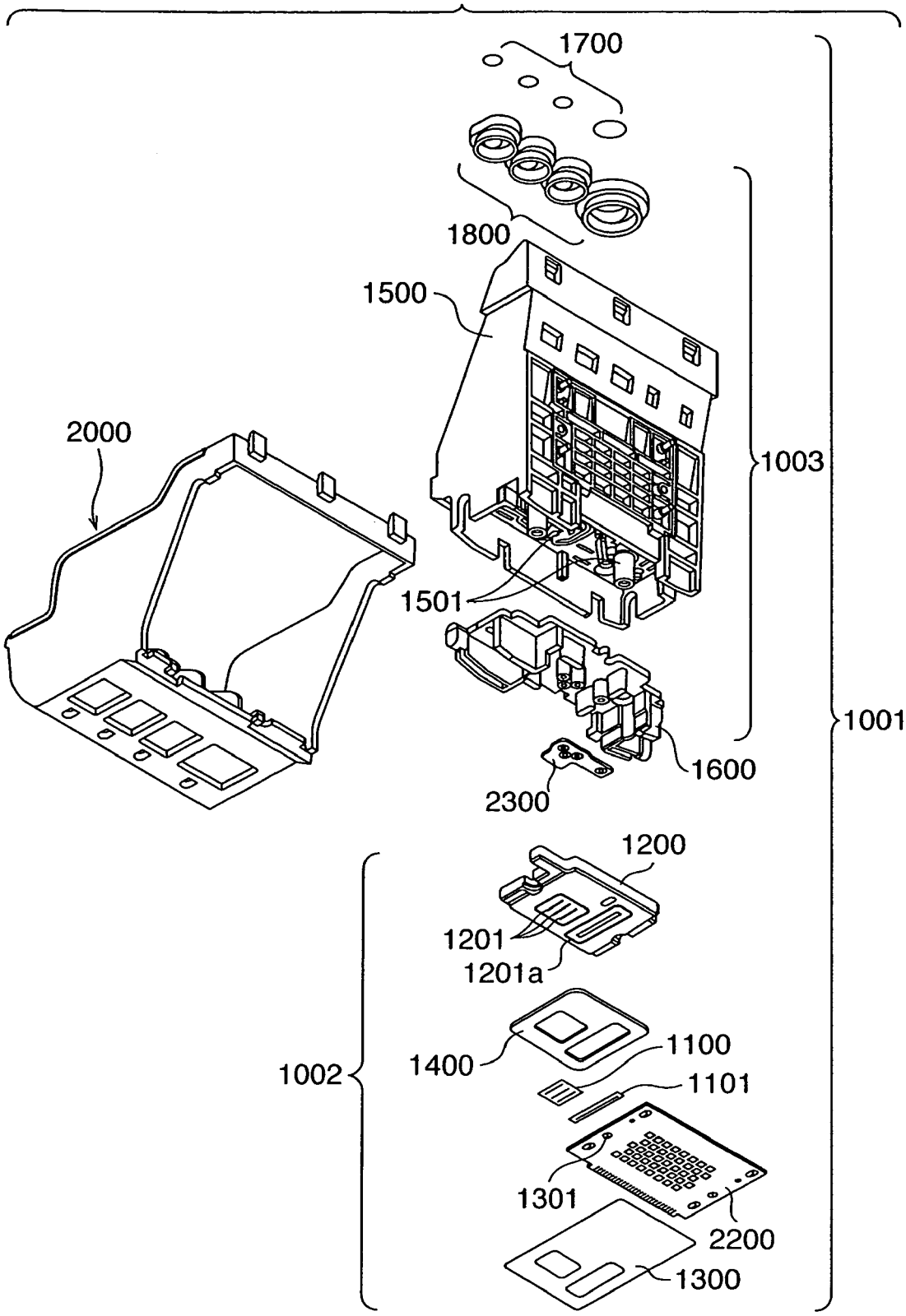
FIG. 3 is an exploded perspective view showing the structure of a printhead shown in FIG. 2.

As shown in FIGS. 2 and 3, the printhead 1001 comprises a printing element unit 1002 which prints a character, image, or the like on a print medium such as print paper, and an ink supply unit 1003 which supplies ink to the printing element unit 1002. Moreover, the printhead 1001 comprises a tank holder 2000 which detachably holds the ink tank 1900 for supplying ink to the ink supply unit 1003.

The printing element unit 1002, ink supply unit 1003, and tank holder 2000 of the printhead 1001 will be explained in detail.

As shown in FIG. 3, the printing element unit 1002 has a printing element substrate 1100, printing element substrate 1101, first plate 1200, electric wiring tape 1300, electric contact substrate 2200, and second plate 1400. Ink supply ports 1201 and 1201*a* are formed in the first plate 1200.

The ink supply unit 1003 has an ink supply member 1500, a channel forming member 1600, a joint rubber 2300, filters 1700, and seal rubbers 1800.

(Printing Element Substrate)

Figure 4:
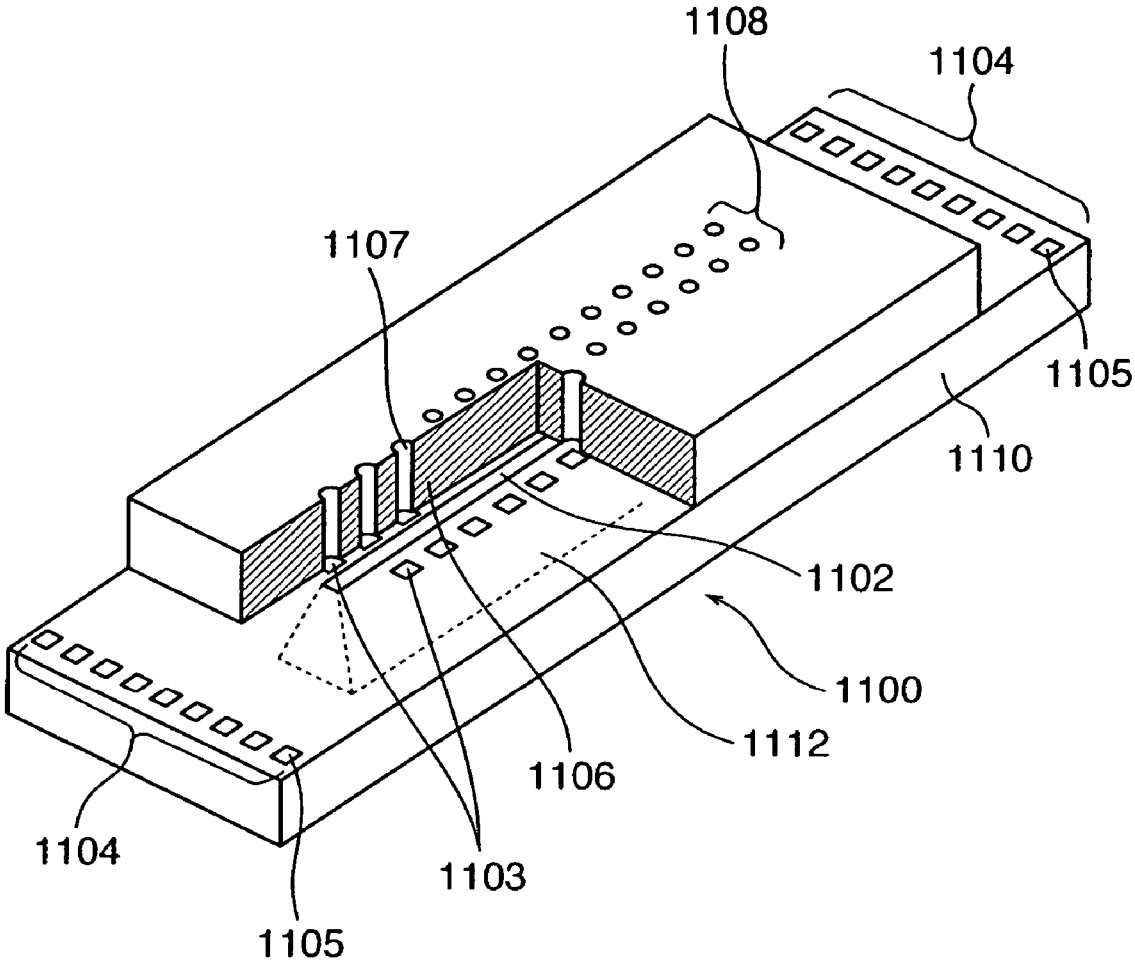
FIG. 4 is a partially cutaway perspective view showing the arrangement of a printing element substrate according to the embodiment of the present invention.

FIG. 4 is a partially cutaway perspective view for explaining the arrangement of the printing element substrate 1100.

The printing element substrate 1100 is used to discharge black ink. A plurality of electrothermal transducers 1103 which generate heat energy in order to discharge ink, and electric wires of Al or the like which supply power to the electrothermal transducers 1103 are formed on one surface of an Si substrate 1110 having about 0.5 to 1 mm in thickness. On the printing element substrate 1100, a plurality of ink channels (not shown) and a plurality of orifices 1107 are formed in correspondence with the electrothermal transducers 1103 by a photolithographic process. The ink channels communicate with a common liquid chamber 1112 having an ink supply port 1102 for supplying ink. The printing element substrate 1100 is bonded and fixed to the first plate 1200.

As shown in FIG. 3, the second plate 1400 having openings is bonded and fixed to the first plate 1200. The electric wiring tape 1300 is so held as to be electrically connected to the printing element substrate 1100 via the second plate 1400. An electrical signal for discharging ink is applied from the electric wiring tape 1300 to the printing element substrate 1100. The electric wiring tape 1300 has an electric wiring portion corresponding to the printing element substrate 1100. The electric contact substrate 2200 has an external signal input terminal 1301 which is arranged in correspondence with the electric wiring portion and receives an electrical signal from the printing apparatus. The external signal input terminal 1301 is positioned and fixed on the rear surface of the ink supply member 1500.

On the printing element substrate 1100, the electrothermal transducers 1103 are staggered on respective arrays on the two sides of the ink supply port 1102. Electrodes 1104 for supplying power to electric wires are arrayed on two sides outside the electrothermal transducers (heaters) 1103. Bumps 1105 of Au or the like are formed on the electrodes 1104. On the Si substrate 1110, the orifices 1107 and an ink channel wall 1106 which forms an ink channel corresponding to each electrothermal transducer 1103 are formed from a resin material by a photolithographic process, forming an orifice group 1108.

Figure 5:
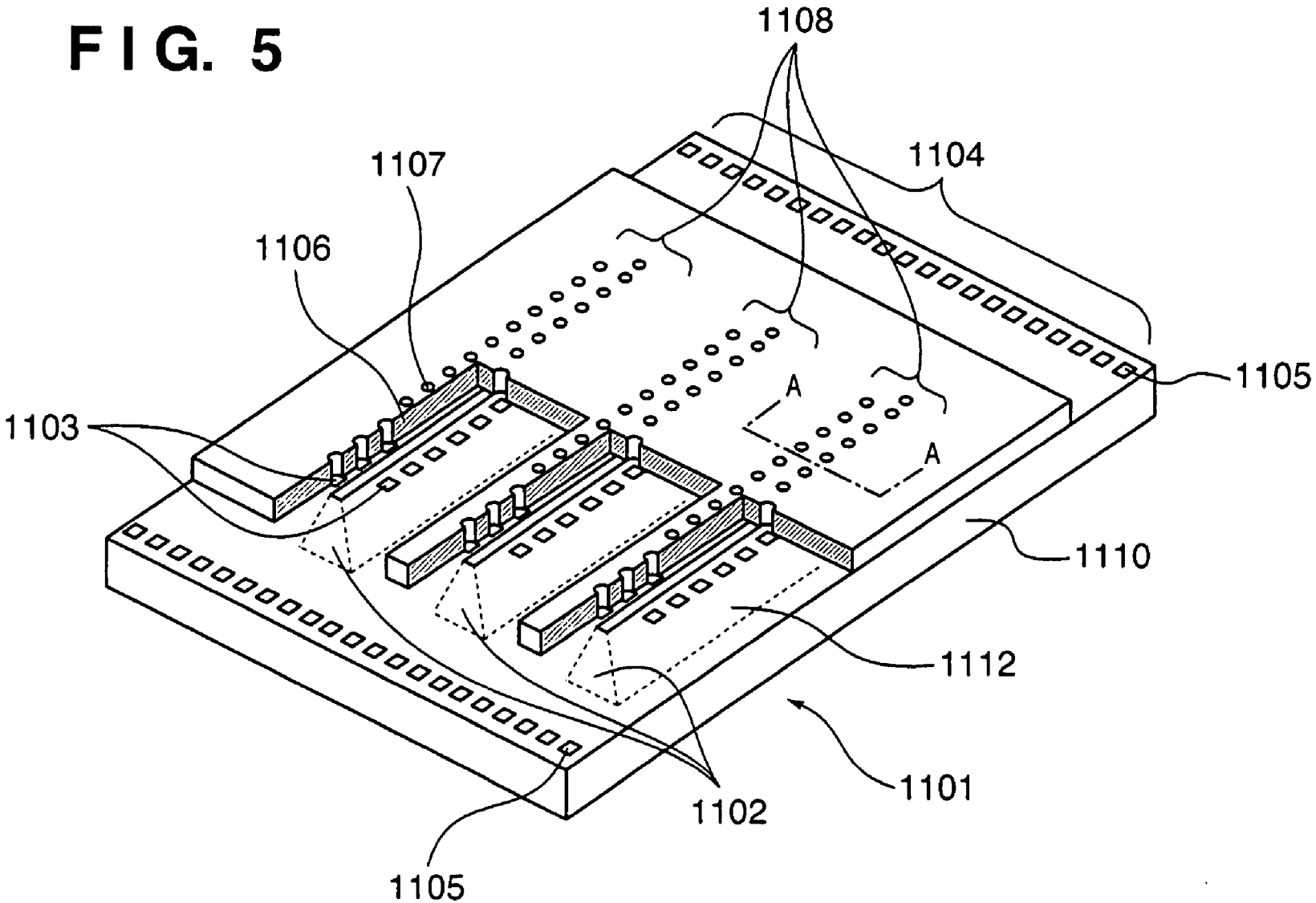
FIG. 5 is a partially cutaway perspective view showing the arrangement of another printing element substrate according to the embodiment of the present invention.

FIG. 5 is a partially cutaway perspective view for explaining the arrangement of the printing element substrate 1101. The printing element substrate 1101 is used to discharge color inks of three colors. In the printing element substrate 1101, three common liquid chambers 1112 having ink supply ports 1102 are formed parallel to each other. The electrothermal transducers 1103 and ink orifices 1107 are formed on the two sides of each ink supply port 1102.

In FIG. 5, the electrothermal transducers 1103 and ink orifices 1107 on the two sides of the ink supply port 1102 are respectively arranged linearly. In practice, the electrothermal transducers 1103 and ink orifices 1107 are staggered to increase the orifice density, which will be described later.

On the printing element substrate 1101, similar to the printing element substrate 1100, ink supply ports 1102, electrothermal transducers 1103, electric wires, electrodes 1104, and the like are formed on an Si substrate 1110. Ink channels and ink orifices 1107 are formed from a resin material on the Si substrate 1110 by a photolithographic process. On the printing element substrate 1101, similar to the printing element substrate 1100, bumps 1105 of Au or the like are formed on the electrodes 1104 for supplying power to electric wires.

As shown in FIG. 3, the printhead 1001 is completed by coupling the printing element unit 1002 to the ink supply unit 1003 and coupling the resultant structure to the tank holder 2000.

(Operation of Printhead Cartridge)

As described above, the tanks of the ink tank 1900 respectively store inks of corresponding colors. Each tank of the ink tank 1900 has an ink supply port (not shown) for supplying ink to the printhead 1001. When the ink tank 1900 is mounted on the printhead 1001, each ink supply port press-contacts a corresponding filter 1700 formed at the joint of the printhead 1001. Then, ink in each tank is supplied from the ink supply port to the printing element substrate 1100 via a corresponding ink supply path 1501 of the printhead 1001 and the first plate 1200.

Ink supplied to the printing element substrate 1100 is supplied into a bubbling chamber positioned at the end of each ink channel having the electrothermal transducer 1103 and orifice 1107. Finally, the ink is discharged as an ink droplet toward a print medium by heat energy applied from the electrothermal transducer 1103.

(Arrangement of Inkjet Printing Apparatus)

An inkjet printing apparatus (to be referred to as a printing apparatus hereinafter) which can mount the cartridge type printhead 1001 will be explained.

Figure 8:
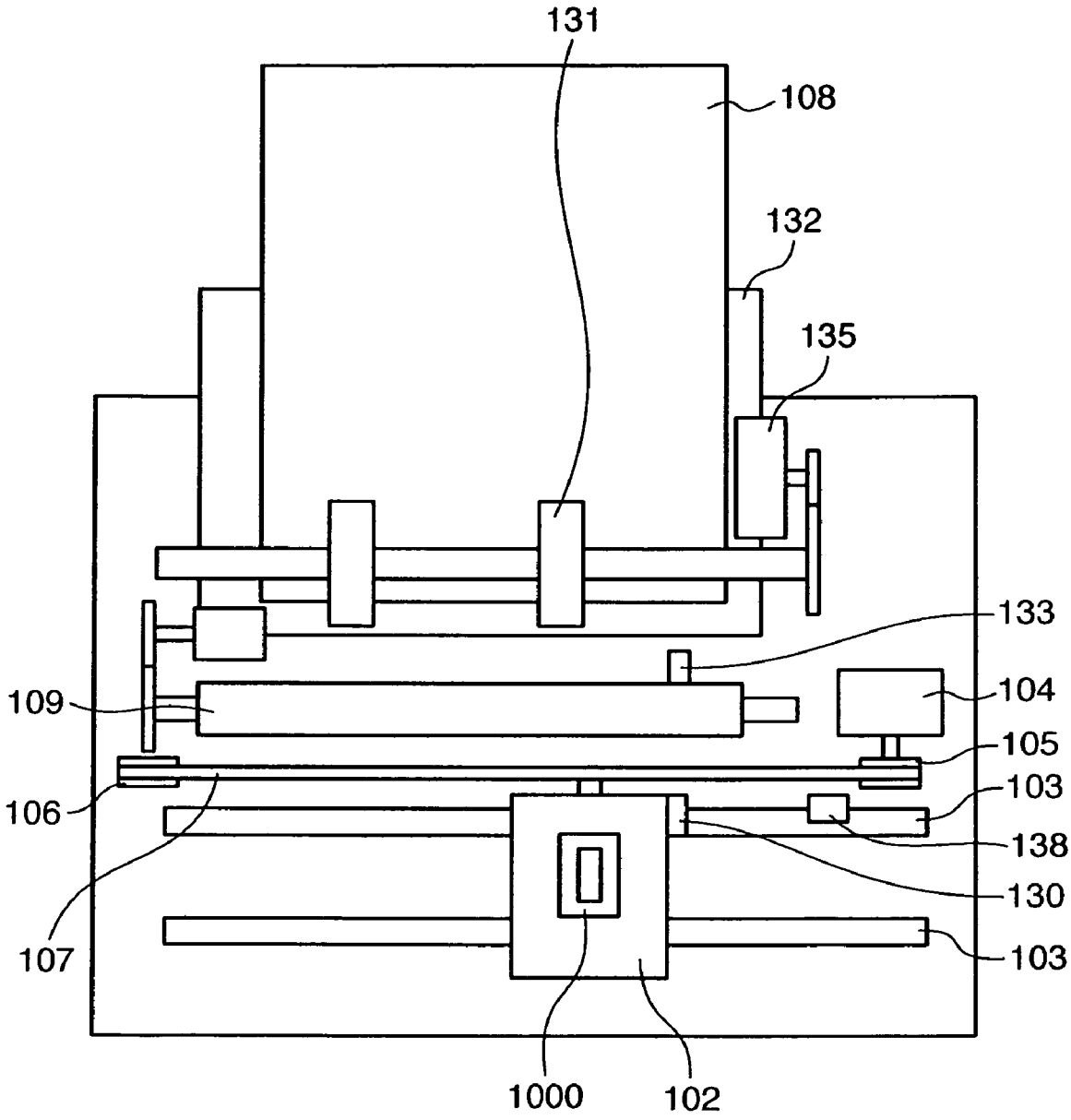
FIG. 8 is a schematic view showing an inkjet printing apparatus which mounts the printhead cartridge shown in FIG. 2.

FIG. 8 is a schematic view showing an example of the arrangement of the printing apparatus which can mount a printhead according to the present invention.

In this printing apparatus, the printhead cartridge 1000 shown in FIG. 2 is positioned and exchangeably mounted on a carriage 102. The carriage 102 has an electrical connection portion for transmitting a driving signal or the like to each discharge portion via the external signal input terminal 1301 of the printhead cartridge 1000.

The carriage 102 is reciprocally guided and supported along a guide shaft 103 which extends in the scan direction of the carriage 102 and is arranged in the apparatus main body. The carriage 102 is connected to a carriage belt 107. When the driving force of a driving motor 104 is transmitted to the carriage belt 107 via pulleys 105 and 106, the carriage 102 moves along the guide shaft 103. The carriage 102 comprises a linear encoder 130 for detecting the moving position of the carriage 102.

A recovery unit 138 which performs a recovery operation of the printhead 1001 is arranged near the home position in the carriage moving direction.

Printing media 108 such as print sheets or thin plastic plates are separated and fed one by one from an auto sheet feeder (ASF) 132 by rotating pickup rollers 131 by a sheet feed motor 135 via a gear. By rotation of a conveyance roller 109, the printing medium 108 is conveyed through a position (printing position) facing to the orifice surface of the printhead cartridge 1000. A sensor 133 which detects the fed printing medium 108 is arranged near the conveyance roller 109.

Note that the carriage scan direction is also called the main scan direction, and the printing medium conveyance direction is also called the sub-scan direction.

The printhead cartridge 1000 is mounted on the carriage 102 so that the array direction of orifices at each discharge portion is perpendicular or diagonal to the scan direction of the carriage 102. Ink droplets are discharged from orifice arrays to print.

The printing apparatus comprises power supply means, and signal supply means for supplying a driving signal for driving the printing element and other signals to the printhead cartridge.

Figure 9:
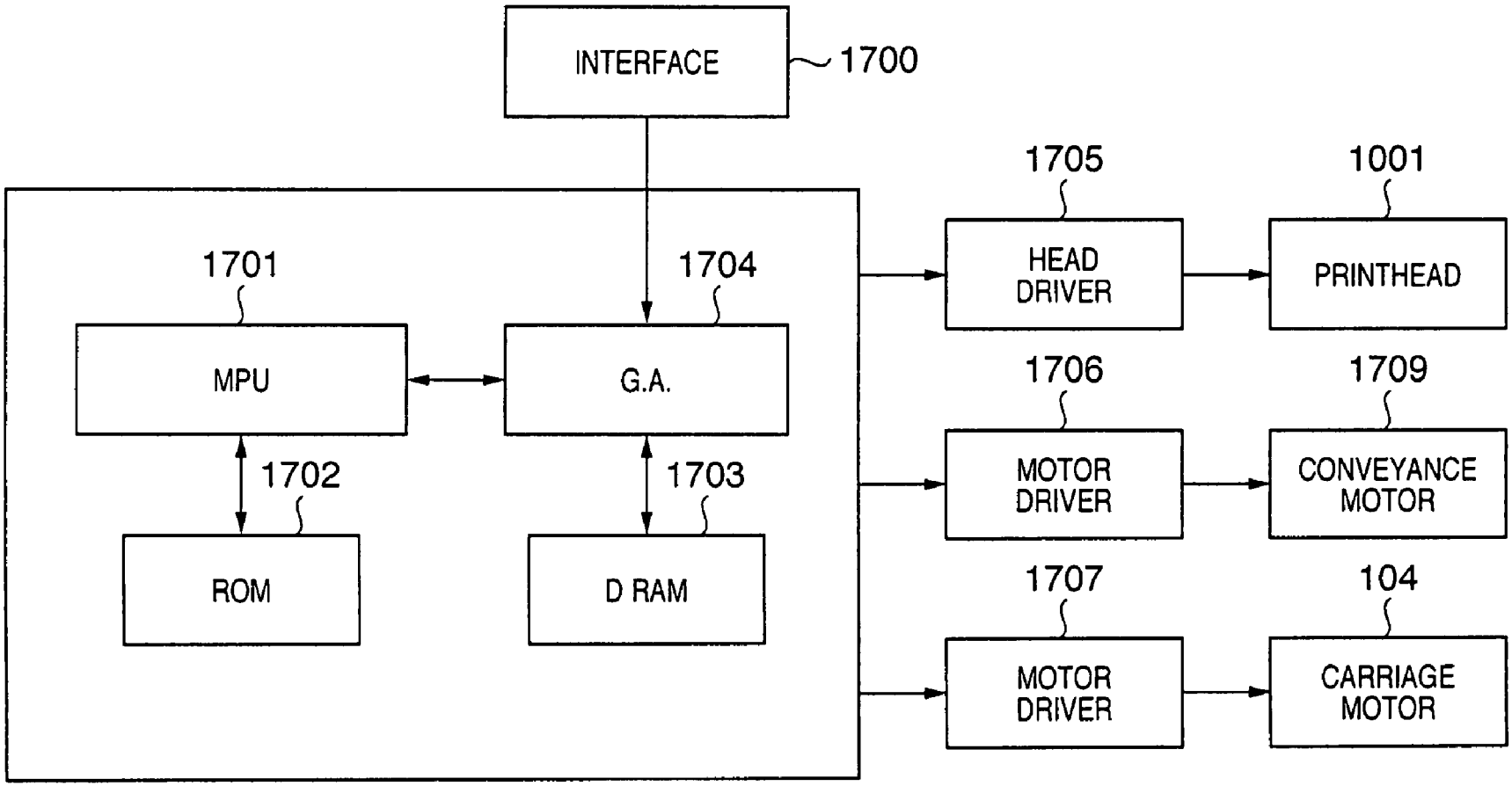
FIG. 9 is a block diagram showing the control configuration of the inkjet printing apparatus shown in FIG. 8.

FIG. 9 is a block diagram showing the configuration of the control circuit of the printing apparatus.

In FIG. 9, reference numeral 1700 denotes an interface which inputs printing data; 1701, an MPU; 1702, a ROM which stores a control program to be executed by the MPU 1701; 1703, a DRAM which saves various data (the above-described printing data, a printing signal supplied to the printhead, and the like); and 1704, a gate array (G.A.) which supplies and controls printing data to the printhead 1001.

The gate array 1704 also controls data transfer between the interface 1700, the MPU 1701, and the DRAM 1703.

The carriage motor 104 moves the carriage 102 to which the printhead 1001 is mounted. Reference numeral 1709 denotes a conveyance motor which conveys a printing medium; 1705, a head driver which drives the printhead 1001; 1706 and 1707, motor drivers which drive the conveyance motor 1709 and the carriage motor 104, respectively.

The operation of the above control configuration will be explained. When printing data is input to the interface 1700, it is converted into a printing signal between the gate array 1704 and the MPU 1701. The motor drivers 1706 and 1707 are driven, and at the same time the printhead 1001 is driven in accordance with the printing signal supplied to the head driver 1705, thereby printing.

The MPU 1701 generates control signals in order to drive and control the printhead 1001. The control signals include a block selection signal for time-divisionally driving the printing elements of the printhead 1001, and a heat enable signal (ENB) for determining the driving period of the printing element. These control signals are supplied to the printhead 1001 via the head driver 1705. The block selection signal is supplied to the printhead 1001 together with the printing signal via the same signal line. Details of these signals will be described later.

(Driving of Printing Element)

The printing element substrate 1101 of the printhead and a method of driving the printing element of the printhead will be described in detail with reference to FIGS. 1A, 1B, 6, and 7.

Figure 1A:
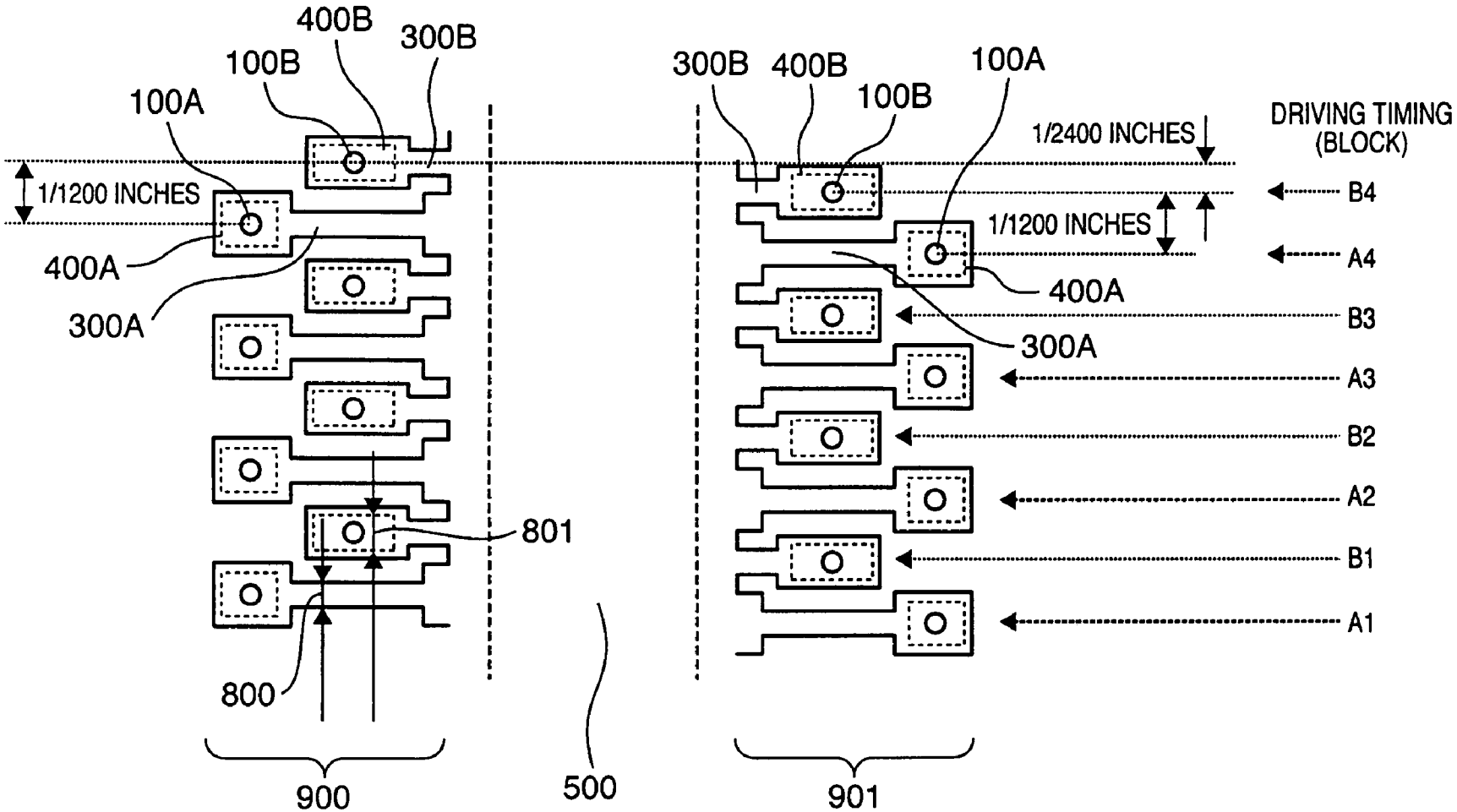
FIG. 1A is an enlarged schematic view showing some orifices and some electrothermal transducers on the second printing element substrate according to an embodiment of the present invention.

FIG. 1A is an enlarged schematic view showing some orifices and some electrothermal transducers for one ink supply port in the printing element substrate 1101. The printing element substrate 1101 is designed so that orifices are laid out at a density of 2,400 orifices per inch for each ink and the ink droplet amount discharged from each orifice is about 1 pl.

In order to lay out orifices at a high density of 1,200 per inch on each side of the ink supply port in the printing element substrate 1101, orifices on the each side are laid out not in a straight line but in a staggered shape. On the printing element substrate 1101, electrothermal transducers 400A and 400B which generate heat energy to be applied to ink are formed around corresponding orifices 100A and 100B. In addition, the shape of the electrothermal transducer is changed in accordance with the distance from an ink supply port 500.

More specifically, the electrothermal transducer 400B (to be referred to as a B type electrothermal transducer hereinafter) close to the ink supply port 500 is elongated in a direction perpendicular to the ink supply port. To the contrary, the electrothermal transducer 400A (to be referred to as an A type electrothermal transducer hereinafter) distant from the ink supply port has almost the square shape. As for the width of the ink channel which communicates with the ink supply port 500, a width 800 of an ink channel 300A extending to the distant orifice 100A (to be referred to as an A type orifice hereinafter) is set to only a width 801 of an elongated heater (B type electrothermal transducer) at most. Since ink is supplied from the ink supply port 500 to the distant orifice 100A, the resistance of the entire ink channel 300A is high, and performance degrades in terms of the repetitive discharge speed of droplets. To prevent this, according to the embodiment, the electrothermal transducer 400A is shaped into almost the square by decreasing the aspect ratio from that of the electrothermal transducer 400B close to the ink supply port 500. This design changes the relationship between the orifice shape and the electrothermal transducer. With this design, the ink discharge performance can improve, and a 1-pl droplet can be more stably discharged regardless of the distance from the ink supply port to the printing element.

The shape of the electrothermal transducer will be examined. When the aspect ratio of the electrothermal transducer decreases and its shape comes close to the square, the ineffective bubbling area (area which is formed owing to a low temperature around the printing element and does not contribute to the bubbling pressure) of the electrothermal transducer (printing element) relatively shrinks. In addition, as for the bubbling power efficiency on the discharge side, the back flow resistance (flow resistance between the ink supply port and the printing element) greatly increases because the channel is longer than that of a printing element close to the ink supply port. Hence, variations between staggered printing elements can be suppressed by decreasing the area of the electrothermal transducer 400A distant from the ink supply port 500. In other words, according to the embodiment, the area of the electrothermal transducer of a printing element (A type printing element) distant from the ink supply port is decreased, and the electrothermal transducer is shaped into the square. With this design, the discharge performance of the A type printing element is made to coincide with that of a printing element (B type printing element) close to the ink supply port.

The areas and ink channel widths of the two types of electrothermal transducers will be further explained with reference to FIG. 1A.

First and second orifice groups 900 and 901 each including a plurality of orifices for discharging a 1-pl ink droplet are respectively arranged on the two sides of the ink supply port 500. Each orifice group includes two orifice arrays, i.e., an array of A type orifices 100A and an array of B type orifices 100B which are parallel in the longitudinal direction (to be referred to as an array direction hereinafter) of the ink supply port 500. In each orifice group, the A type orifices 100A and B type orifices 100B are staggered from each other in the array direction. The distance between two adjacent orifices in the array direction is set to 1/1200 inches. The two orifice groups 900 and 901 are shifted by only 1/2400 inches in the array direction. In this manner, the layout density of orifices for each ink is set to 2,400 orifices per inch on the printing element substrate 1101.

In each orifice group (900 or 901), the electrothermal transducers 400A and 400B which are arranged in correspondence with the A and B type orifices 100A and 100B communicate with the ink supply port 500 via the corresponding ink channels 300A and 300B. The width 800 of the ink channel 300A corresponding to the A type orifice 100A is limited by the width 801 of the B type electrothermal transducer 400B, and is set only almost equal to or smaller than the width 801. For proper discharge, when orifices are to be laid out at a high density of 1,200 orifices or more per inch in consideration of a small space which is necessary between the electrothermal transducer and the partition, orifices are laid out more desirably in a staggered shape than in a straight line while considering the shape of the electrothermal transducer.

In the embodiment, the areas of the two types of orifices 100A and 100B are set equal to 70 $\mu m^2$ in order to adjust ink droplet amounts discharged from all orifices to 1 pl. The size of the electrothermal transducer is designed to 10 μm wide× 28 μm long for the B type electrothermal transducer 400B and 14 μm wide×18 μm long for the A type electrothermal transducer 400A. The area of the electrothermal transducer is 280 $\mu m^2$ for the B type and 252 $\mu m^2$ for the A type. By setting the area of the A type electrothermal transducer 400A smaller than that of the B type electrothermal transducer 400B, the effective area which actually contributes to discharge is adjusted to balance the discharge abilities of the two types of orifices.

As described above, in the embodiment, the two types of electrothermal transducers, which are laid out at positions at different distances from the ink supply port, are different in size. In order to drive the two types of electrothermal transducers at high speed, optimal energies corresponding to them must be supplied.

The printing element substrate is obtained by forming heating elements (heaters) as electrothermal transducers on a semiconductor substrate in the film forming process. Thus, the resistance difference between heating elements on the same substrate is substantially determined by the element shape (aspect ratio). Further, it is known that the temperature of the heating element is determined by energy per unit area. In the embodiment, the area of the A type electrothermal transducer 400A is set smaller (downsized) than that of the B type electrothermal transducer 400B, and the aspect ratio (the size in a direction in which the current flows is dominant) is also set smaller (formed into the square), i.e., the resistance is set lower.

Since the resistance value of the electrothermal transducer 100A is different from that of the electrotheremal transducer 100B, when driving pulses of the same width (time) are applied to these electrotheremal transducers, energy generated by an electrothermal transducer of either type becomes excessive or short, failing in normal discharge. More specifically, if a driving pulse appropriate for the A type electrothermal transducer is set, energy generated by the B type electrothermal transducer becomes excessive. To the contrary, if a driving pulse appropriate for the B type electrothermal transducer is set, energy generated by the A type electrothermal transducer becomes short.

To prevent this, the embodiment gives attention to the fact that the printing elements of the printhead are time-divisionally driven. The printhead is configured so that driving signals (ENB signals) of different widths are applied to the A and B types via a common driving signal line (ENB signal line) to properly drive the two types of electrothermal transducers having different shapes.

Figure 1B:
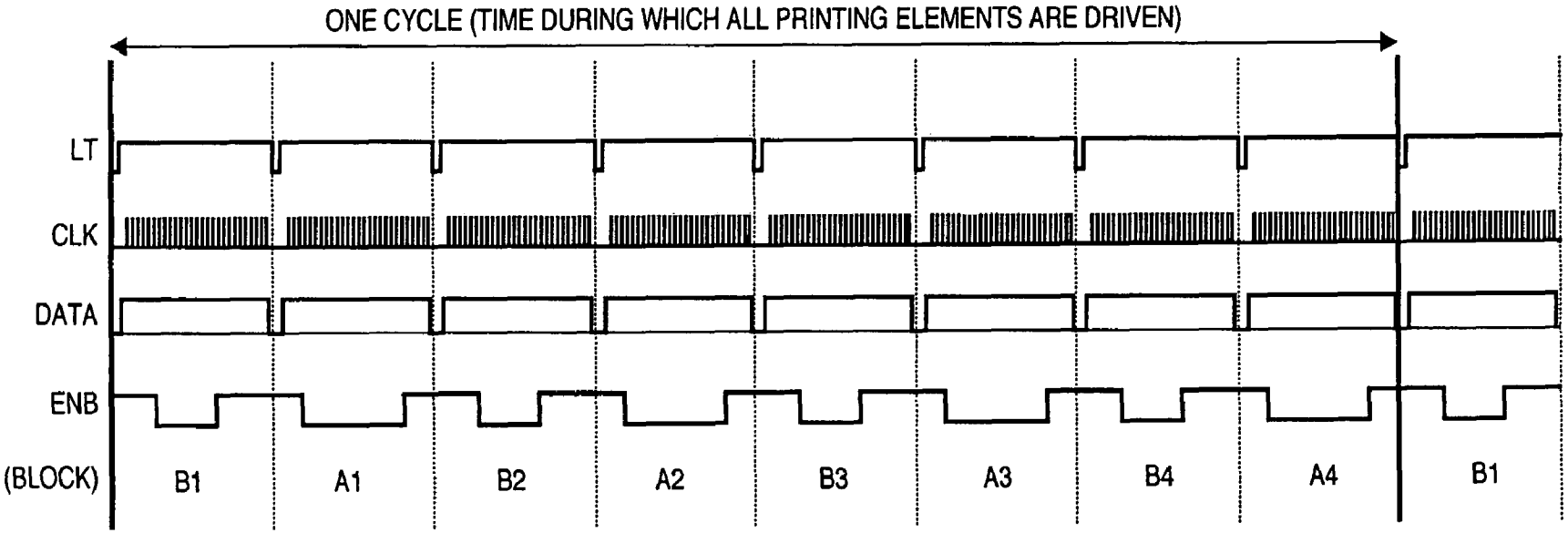
FIG. 1B is a timing chart showing a signal associated with driving of the electrothermal transducer in FIG. 1A.

FIG. 1B is a timing chart showing a signal supplied from the printing apparatus main body.

As shown in FIG. 1B, all printing elements are driven divisionally at eight timings (time division count=8). In each of block periods serving as eight divided timings, electrothermal transducers of the same type are driven. In addition, the pulse width of the ENB signal which determines the driving period is changed in each block period in accordance with the shape (type) of the electrothermal transducer.

In FIG. 1B, eight symbols (B1, A1, . . . , B4, and A4) described in the block period (BLOCK) correspond to symbols on the right side of FIG. 1A. That is, A type electrothermal transducers are driven in block periods with a prefix "A", whereas B type electrothermal transducers are driven in block periods with a prefix "B". By using a single ENB signal, proper energies (powers) can be applied to drive the two types of electrothermal transducers having different shapes.

In FIG. 1B, the period during which the ENB signal is at low level in each of the eight divided block periods B1, A1, B2, A2, B3, A3, B4, and A4 is a driving period during which power is applied to the electrothermal transducer. The interval between driving periods is an idle period during which the printing element is refilled with ink by the discharge amount. As shown in FIG. 1B, in the embodiment, the start timings of the driving periods of the A and B type electrothermal transducers are set so that the durations of idle periods become almost equal to each other.

Figure 6:
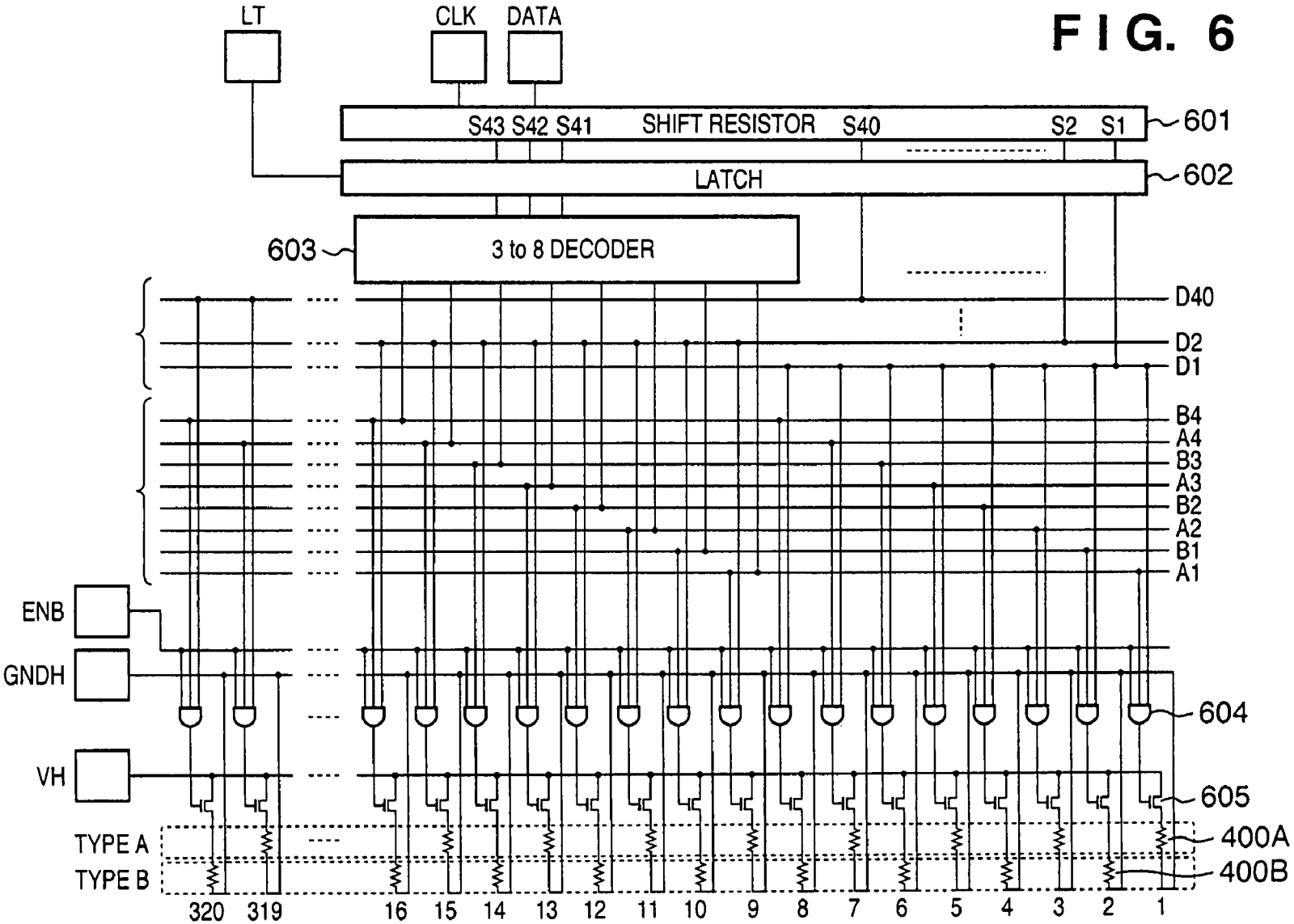
FIG. 6 is a block diagram showing the circuit of the second printing element substrate according to the embodiment of the present invention.

Signals LT, CLK, DATA, and ENB shown in FIG. 1B will be explained with reference to FIG. 6 showing the internal circuit of the printing element substrate 1101.

FIG. 6 is a block diagram showing a circuit configuration corresponding to one of the two orifice groups shown in FIG. 1A. The circuit shown in FIG. 6 corresponds to 320 orifices contained in one orifice group, and the number of orifices corresponding to one ink supply port is 640.

In FIG. 6, reference numeral 601 denotes a shift register which receives and holds, bit by bit in accordance with a clock signal (CLK), image data input as a printing signal (DATA) and a block selection signal for designating a block to be time-divisionally driven. Reference numeral 602 denotes a latch which temporarily latches a signal held by the shift register 601 at the input timing of a latch signal (LT) during driving of the electrothermal transducer. Reference numeral 603 denotes a 3 to 8 decoder which decodes a 3-bit block selection signal latched by the latch 602 into eight block signals. Reference numeral 604 denotes each AND circuit which performs AND-operation of the ENB signal, a block signal output from the 3 to 8 decoder 603, and a signal which makes an electrothermal transducer correspond to a block and is supplied from one of matrix-wired lines. Reference numeral 605 denotes a switching element which drives a corresponding electrothermal transducer in accordance with an output from the AND circuit 604. Reference symbol VH denotes a power supply terminal for supplying energy to the electrothermal transducer. Reference symbol GNDH denotes a GND terminal to which the electrothermal transducer is connected via the switching element. Reference symbol ENB denotes an ENB terminal for receiving an ENB signal supplied from the head driver 1705 of the printing apparatus main body, as described above.

A circuit which is arranged in the printing apparatus main body and generates the ENB signal can be implemented by various circuits, in addition to the above-described configuration. For example, a circuit can be adopted which changes the pulse width of an output signal by adjusting the timing when a counter which receives the clock signal (CLK) is reset. A circuit of another configuration is also available.

In this configuration, electrothermal transducers of the same type are driven at the same timing in eight time-division block periods in the order of B1, A1, B2, A2. B3, A3, B4, and A4 on the printing element substrate. More specifically, the pulse width (driving period) of the ENB signal is changed between block periods (A1, A2, A3, and A4) corresponding to A type electrothermal transducers and block periods (B1, B2, B3, and B4) corresponding to B type electrothermal transducers. This setting optimizes electric energies (powers) applied to the two types of electrothermal transducers.

According to the above-described embodiment, appropriate powers can be applied to the two types of electrothermal transducers having different shapes without increasing the number of signal lines between the printhead and the apparatus main body, complicating the circuit configuration, and decreasing the printing speed.

<Modification>

In the above embodiment, the eight time-division block periods are equal to each other, but this does not limit the present invention. In a configuration in which the frequency of the clock CLK is increased to shorten the data transfer time, the duration of the driving period may be changed in accordance with the type of electrothermal transducer.

Figure 7:
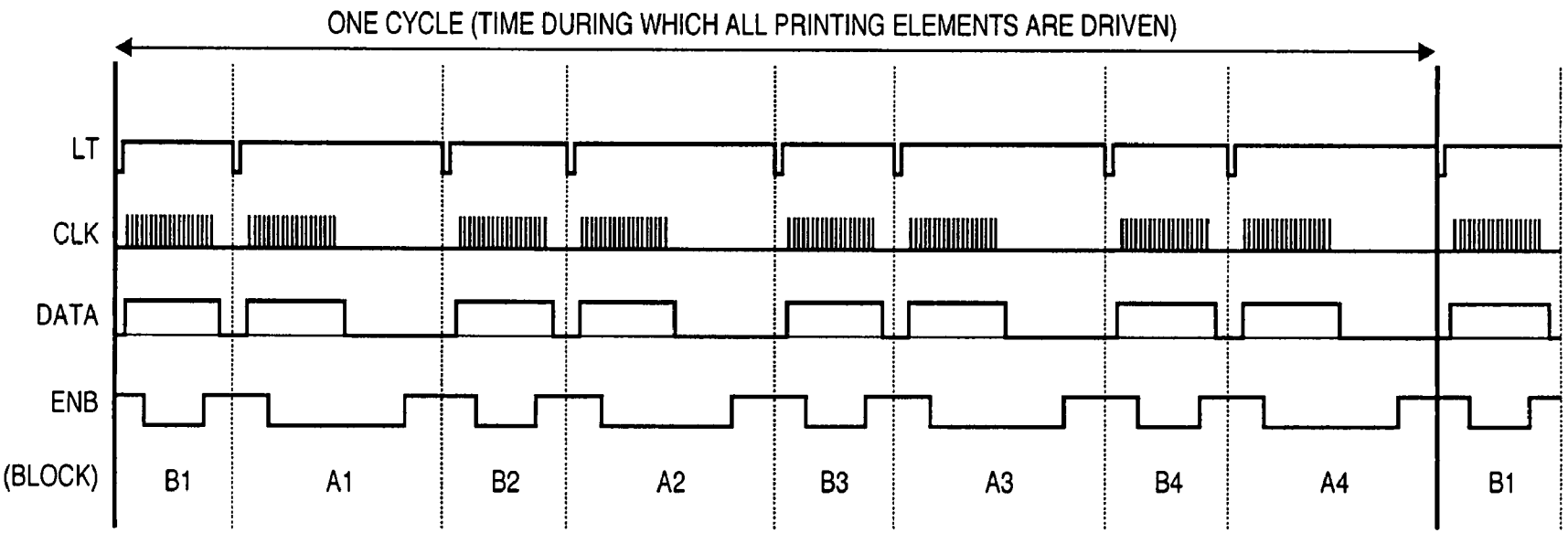
FIG. 7 is a timing chart showing a signal according to a modification.

Similar to FIG. 1B, FIG. 7 is a timing chart showing a signal associated with driving of the electrothermal transducer according to the modification. As shown in FIG. 7, the block periods B1, B2, B3, and B4 are set shorter than the block periods A1, A2, A3, and A4 in accordance with the duration of the driving period of each type of electrothermal transducer. As a result, the time of one cycle during which all electrothermal transducers are driven once is shortened. Also in this modification, the start timings of the driving periods of the A and B type electrothermal transducers are set so that the durations of idle periods become almost equal to each other.

Other Embodiment

In the above embodiment, electrothermal transducers respectively arranged in 320 orifices which are laid out at high density on one side of the ink supply port are divided into eight and time-divisionally driven. However, the number of orifices, the time division count, and the circuit configuration are not limited to the above-described ones, and the present invention can be applied to printing apparatuses having printheads of various specifications.

The present invention can also be applied to a printing apparatus which prints by a printing method other than the inkjet method as far as the printhead comprises at least two types of energy generating elements which require different application powers in order to obtain a desired printing characteristic.

For example, orifices (printing elements) may be linearly laid out, or the number of types of energy generating elements (electrothermal transducers) which require different application powers may be three or more. The mechanical structure is not limited to a serial type, and a print medium may be moved relatively to the printhead.

In addition, the form of the printing apparatus to which the present invention is applied is not limited to an integrated or separate image output terminal for an information processing device such as a computer. In addition, the printing apparatus may take the form of a copying apparatus combined with a reader, a facsimile apparatus having a transmission/reception function, or a multi-functional peripheral having these functions.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2005-106799 filed on Apr. 1, 2005, the entire contents of which are incorporated herein by reference.

What is claimed is:

1. A printhead having a substrate including at least first type printing elements and second type printing elements, wherein the first type printing elements form a first printing element array, the second type printing elements form a second printing element array, the first type printing elements are divided into first type blocks, each being concurrently driven in time-divisional drive, and the second type printing elements are divided into second type blocks, each concurrently driven in the time-divisional drive comprising:

wirings for connecting part of the first type printing elements which belongs to the same block of the first type blocks and connecting part of the second type printing elements which belongs to the same block of the second type blocks to form plural blocks for the time-divisional drive;

a time-division driving circuit, provided on the substrate, which selects a block of the plural blocks to time-divisionally and alternately drive the first and second type printing elements in corresponding first and second periods; and a common signal line, provided on the substrate, which supplies, to the first and second type printing elements, enable signals for designating different driving periods during which power is supplied in the first and second periods, wherein shapes of the first and second type printing elements are different from each other.

2. The printhead according to claim 1, wherein the first type printing elements are arranged at positions more distant from an ink supply port of the printhead than positions where the second type printing elements are arranged, and the first and second type printing elements are staggered.

3. The printhead according to claim 2, wherein a resistance value of each of the first type printing elements is smaller than that of the second type printing elements.

4. The printhead according to claim 2, wherein energy supplied via the common signal line to each of the first type printing elements is greater than that to each of the second type printing elements.

5. The printhead according to claim 1, wherein the first and second type printing elements are laid out on the same substrate at a density of not less than 1,200 printing elements per inch in a predetermined direction.

6. The printhead according to claim 1, further comprising an orifice for discharging ink, corresponding to each printing element.

7. The printhead according to claim 6, wherein the printing element is an electrothermal transducer.

8. A printing apparatus which prints with a printhead having at least first type printing elements and second type printing elements, wherein the first type printing elements form a first printing element array, the second type printing elements form a second printing element array, the first type printing elements are divided into first type blocks, each being concurrently driven in time-divisional drive, and the second type printing elements are divided into second type blocks, each concuffently driven in the time-divisional drive, comprising:

a signal generating circuit which generates time-division signals representing first and second periods corresponding to the first and second type printing elements; and a driving circuit which supplies, to the first and second type printing elements by using a common signal line, enable signals for designating different driving periods during which power is supplied in the first and second periods, wherein the time-division signals are supplied to the first and second type blocks, for time-divisionally and alternately driving the first and second type printing elements, and shapes of the first and second type printing elements are different from each other.

* * * * *